US009090100B2

(12) United States Patent
Verdugo et al.

(10) Patent No.: US 9,090,100 B2
(45) Date of Patent: Jul. 28, 2015

(54) DETERMINATION OF A MEDIA MALFUNCTION EVENT BASED ON A SHAPE OF A MEDIA PORTION

(71) Applicant: HEWLETT-PACKARD DEVELOPMENT COMPANY, L.P., Houston, TX (US)

(72) Inventors: Antonio Gracia Verdugo, Barcelona (ES); Mauricio Seras Franzoso, Barcelona (ES); Valentin Fernández Jiménez, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 92 days.

(21) Appl. No.: 13/860,757

(22) Filed: Apr. 11, 2013

(65) Prior Publication Data

US 2014/0307021 A1 Oct. 16, 2014

(51) Int. Cl.

| | |
|---|---|
| ***B41J 29/393*** | (2006.01) |
| ***B41J 11/00*** | (2006.01) |
| ***B41J 11/06*** | (2006.01) |

(52) U.S. Cl.

CPC ..... *B41J 11/001* (2013.01); *B41J 11/0085* (2013.01); *B41J 11/0095* (2013.01); *B41J 11/06* (2013.01)

(58) Field of Classification Search

USPC ..... 347/3, 16, 19, 101, 104; 358/498

See application file for complete search history.

(56) References Cited

U.S. PATENT DOCUMENTS

| | | | | |
|---|---|---|---|---|
| 5,710,634 | A * | 1/1998 | Kuriyama et al. | 358/498 |
| 6,377,758 | B1 | 4/2002 | OuYang et al. | |
| 7,287,824 | B2 * | 10/2007 | Subirada et al. | 347/19 |
| 8,382,276 | B2 * | 2/2013 | Ikeda | 347/104 |
| 2008/0013848 | A1 | 1/2008 | Wu et al. | |
| 2012/0013733 | A1 | 1/2012 | Koltermann et al. | |
| 2012/0013935 | A1 | 1/2012 | Adachi | |
| 2012/0237087 | A1 | 9/2012 | Wu et al. | |

OTHER PUBLICATIONS

Rahaman et al.; Automatic Defect Detection and Classification Technique From Image: a Special Case Using Ceramic Tiles; (IJCSIS) International Journal of Computer Science and Information Security, vol. 1, No. 1, May 2009.

* cited by examiner

*Primary Examiner* — Kristal Feggins

(74) *Attorney, Agent, or Firm* — Hewlett-Packard Patent Department

(57) ABSTRACT

A printing apparatus includes a media support assembly, a scanning module, and a control module. The media support assembly may position a respective media portion in a print zone to receive a printing fluid thereon. The scanning module may scan the media portion in the print zone and generate a media shape signal corresponding to a shape of the media portion. The control module may compare the media shape signal to a reference signal to form a resultant comparison and determine a media malfunction event based on the resultant comparison.

18 Claims, 7 Drawing Sheets

DETERMINATION OF A MEDIA MALFUNCTION EVENT BASED ON A SHAPE OF A MEDIA PORTION

BACKGROUND

A printing apparatus may include a media support assembly and a printhead. The media support assembly may sequentially position a respective media portion of a plurality of media portions in a print zone to receive a printing fluid thereon in accordance with a print job. The printhead may apply the printing fluid to the respective media portion in the print zone in a form of swaths to form an image thereon.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

A printing apparatus may include a media support assembly and a printhead. The media support assembly may sequentially position a respective media portion of a plurality of media portions in a print zone to receive a printing fluid thereon in accordance with a print job. The printhead may apply the printing fluid to the respective media portion in the print zone in a form of swaths to form an image thereon. Media malfunction events such as media distortions leading to wrinkles and misplacement of printing fluid drops on the media resulting in banding, smears, and the like may occur at various stages during a respective print job. Such media malfunction events may render the print job unusable and, thus, the printing fluid and media used for the respective print job may be wasted.

In examples, a printing apparatus includes a media support assembly, a scanning module, and a control module. The media support assembly may position a respective media portion in a print zone to receive a printing fluid thereon. The scanning module may scan the media portion in the print zone and generate a media shape signal corresponding to a shape of the media portion. The control module may compare the media shape signal to a reference signal to form a resultant comparison and determine a media malfunction event based on the resultant comparison. Accordingly, a timely determination of the media malfunction event may reduce the continued waste of additional printing fluid and media in order to complete the respective print job deemed unusable.

Figure 1:
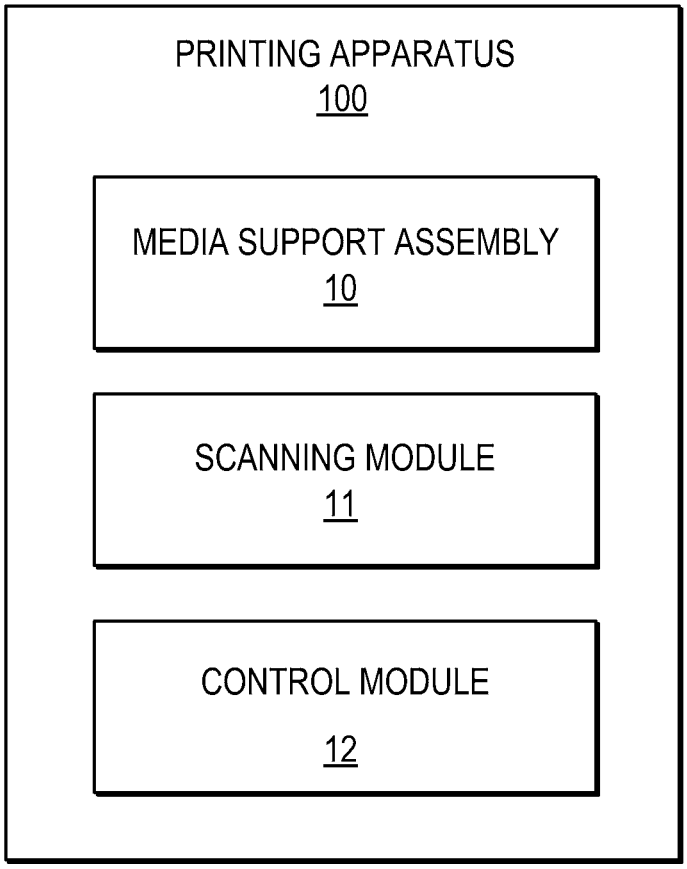
FIG. 1 is a block diagram illustrating a printing apparatus according to an example.

FIG. 1 is a block diagram illustrating a printing apparatus according to an example. Referring to FIG. 1, in some examples, a printing apparatus 100 includes a media support assembly 10, a scanning module 11, and a control module 12. The media support assembly 10 may position a respective media portion in a print zone to receive a printing fluid thereon. In some examples, the media support assembly 10 may sequentially position a respective media portion of a plurality of media portions in a print zone to receive a printing fluid thereon in accordance with a print job. The scanning module 11 may scan the media portion in the print zone and generate a media shape signal corresponding to a shape of the media portion. In some examples, the scanning module 11 may continuously scan respective media portions in the print zone.

Figure 2:
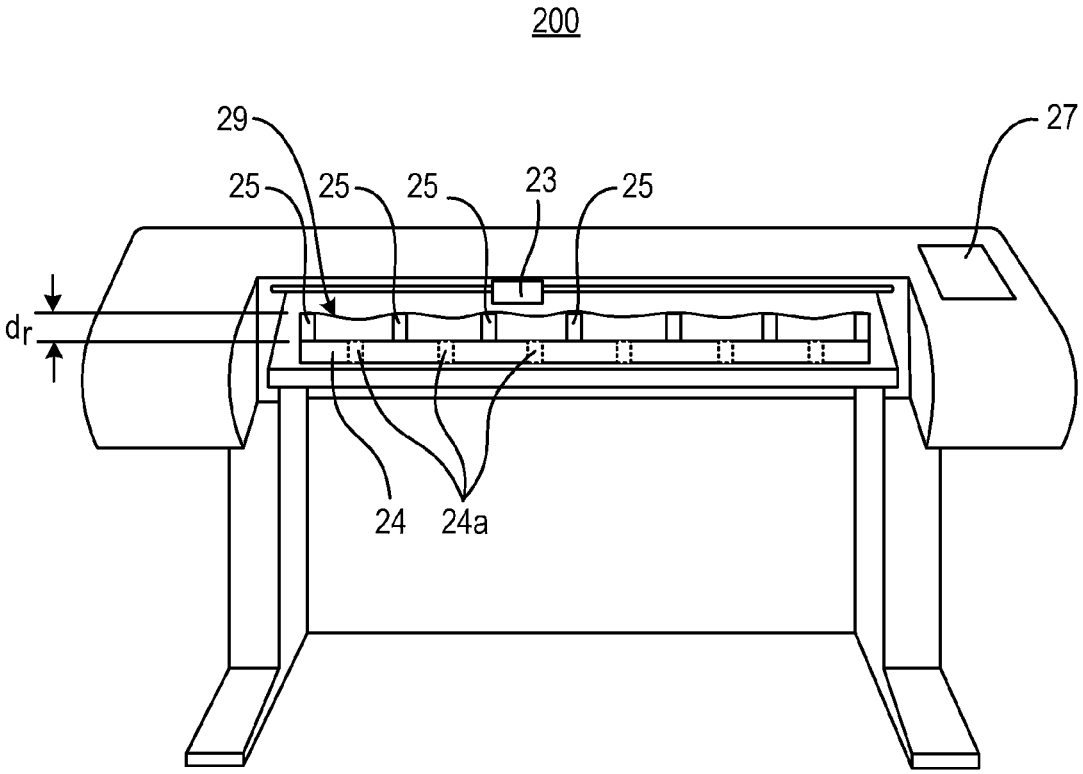
FIG. 2 is a perspective view illustrating a printing apparatus according to an example.
Figure 3:
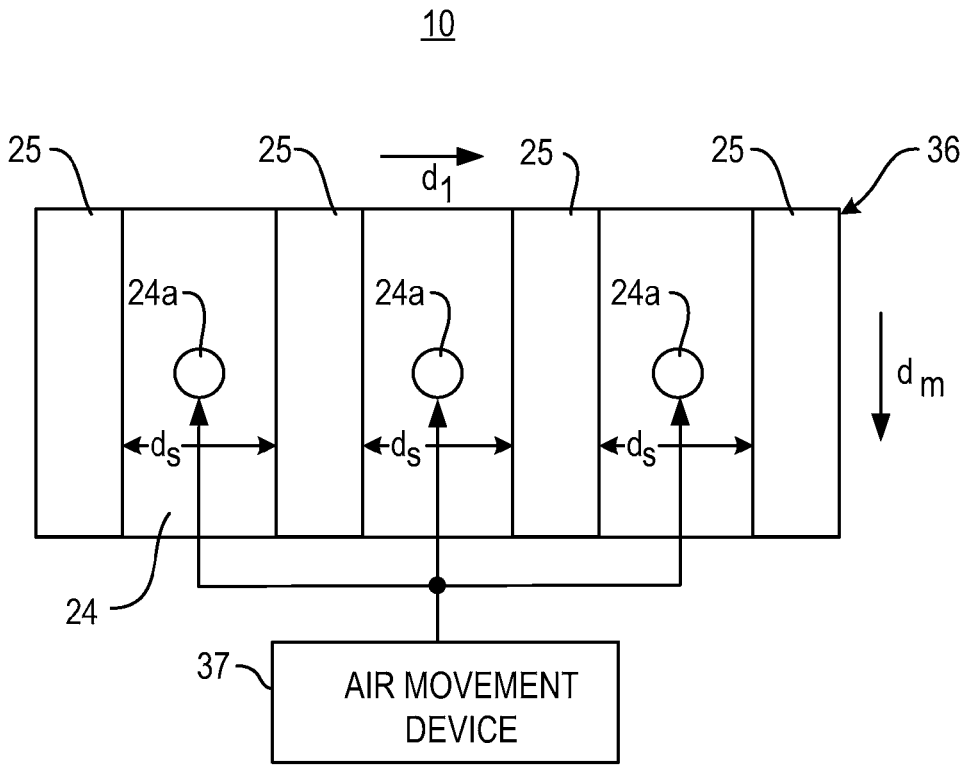
FIG. 3 is a schematic view of a media support assembly of the printing apparatus of FIG. 2 according to an example.
Figure 4:
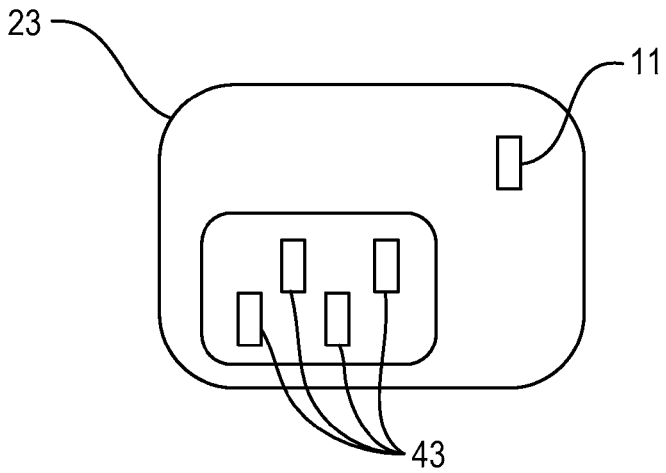
FIG. 4 is a bottom view of a carriage of the printing apparatus of FIG. 2 according to an example.

For example, the scanning module 11 may determine a shape of a surface area of the media portion in the print zone over a respective time period and/or a respective distance based on respective variations in distances between the scanning module 11 and the surface area. In some examples, the shape of the media portion may be based on an amount of conformity of the media portion to a portion of the media support assembly 10. The control module 12 may compare the media shape signal to a reference signal to form a resultant comparison and determine a media malfunction event based on the resultant comparison. Media malfunction events, for example, may include media distortions leading to wrinkles and misplacement of printing fluid drops on the media resulting in banding, smears, and the like. In some examples, the resultant comparison may include a determination as to whether the media shape signal differs from the reference signal, for example, by an offset amount outside of an acceptable range. In some examples, the printing apparatus may include a multifunction printer, a large format printer, a plotter, and the like, FIG. 2 is a perspective view illustrating a printing apparatus according to an example. FIG. 3 is a schematic view of a media support assembly of the printing apparatus of FIG. 2 according to an example. FIG. 4 is a bottom view of a carriage of the printing apparatus of FIG. 2 according to an example. Referring to FIGS. 2-4, in some examples, a printing apparatus 200 may include the media support assembly 10, the scanning module 11, and the control module 12 as previously described with respect to the printing apparatus 100 of FIG. 1. The media support assembly 10 may position a respective media portion 29 in a print zone to receive printing fluid thereon. The print zone may correspond to an area to receive a respective media portion 29 therein to receive printing fluid thereon. The media portion 29, for example, may be a portion of roll media, a portion of a sheet of media, an entire sheet of media, and the like.

Referring to FIGS. 2-4, in some examples, the media support assembly 10 may transport media in a media transport direction $d_m$ along a media transport path to position the respective media portion 29 in a print zone. The media support assembly 10 may continue to position subsequent media portions in the print zone based on print job requirements. For example, a respective print job may include printing on multiple media portions. The media support assembly 10 may include a platen 36 and an air movement device 37. The platen 36 may include a main surface 24 and a plurality of ribs 25. The main surface 24 may include a plurality of holes 24*a*. The ribs 25 may be spaced apart from each other by respective distances $d_s$. In some examples, the ribs 25 may be equally-spaced from each other in a first direction $d_1$ along the platen 36.

Referring to FIGS. 2-4, in some examples, the first direction $d_1$ may be substantially perpendicular to a media transport direction $d_m$. The ribs 25 may extend outward from the main surface 24, That is, each one of the ribs 25 may extend away from the main surface 24 by a respective distance $d_1$. The air movement device 37 may be in fluid communication with the plurality of holes 24*a*. In some examples, the air movement device 37 may be a pump, and the like. In some examples, the air movement device 37 may selectively move air to create an amount of negative pressure through the plurality of holes 24*a*.

Referring to FIGS. 2-4, in some examples, the printing apparatus 200 may include a carriage 23. The carriage 23 may be coupled to the scanning module 11 and a printhead 43. The scanning module 11 and the printhead 43, for example, may be disposed on a surface of the carriage 23 to face the print zone. The scanning module 11 may include a line scanner, for example, such as a light emitting diode emission and diffuse photoreceptor. The printhead 43 may include a fluid applicator unit, printhead modules, printhead dies, a printhead bar, and/or a printhead assembly, and the like. The carriage 23 may move the scanning module 11 across the print zone to scan the media portion 29. The carriage 23 may also be coupled to a printhead 43 to move the printhead 43 across the print zone. For example, the carriage 23 may move back and forth in the first direction $d_1$. The printhead 43 may apply printing fluid to the media portion 29 disposed in the print zone. For example, the printhead 43 may form a respective swath on the media portion 29 during a respective sweep of the printhead 43 coupled to the carriage 23 across the print zone.

Figure 5A:
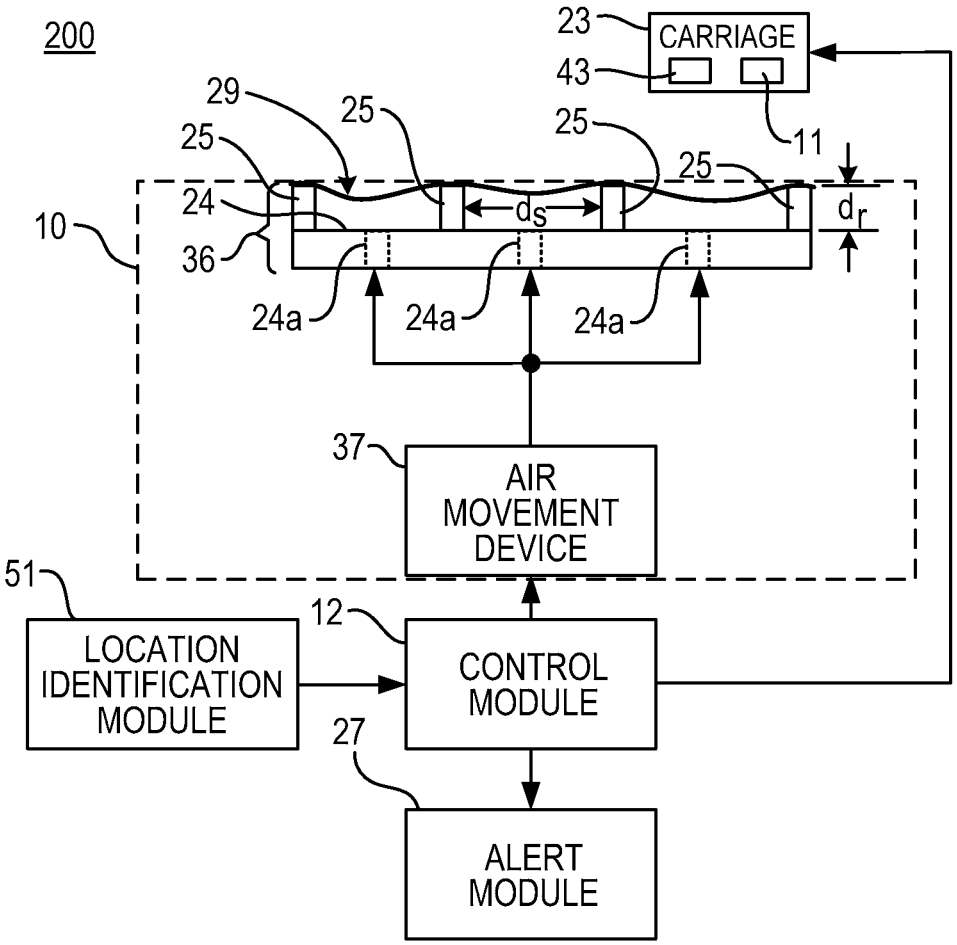
FIGS. 5A and 5B are schematic views of the printing apparatus of FIG. 2 according to examples.
Figure 5B:
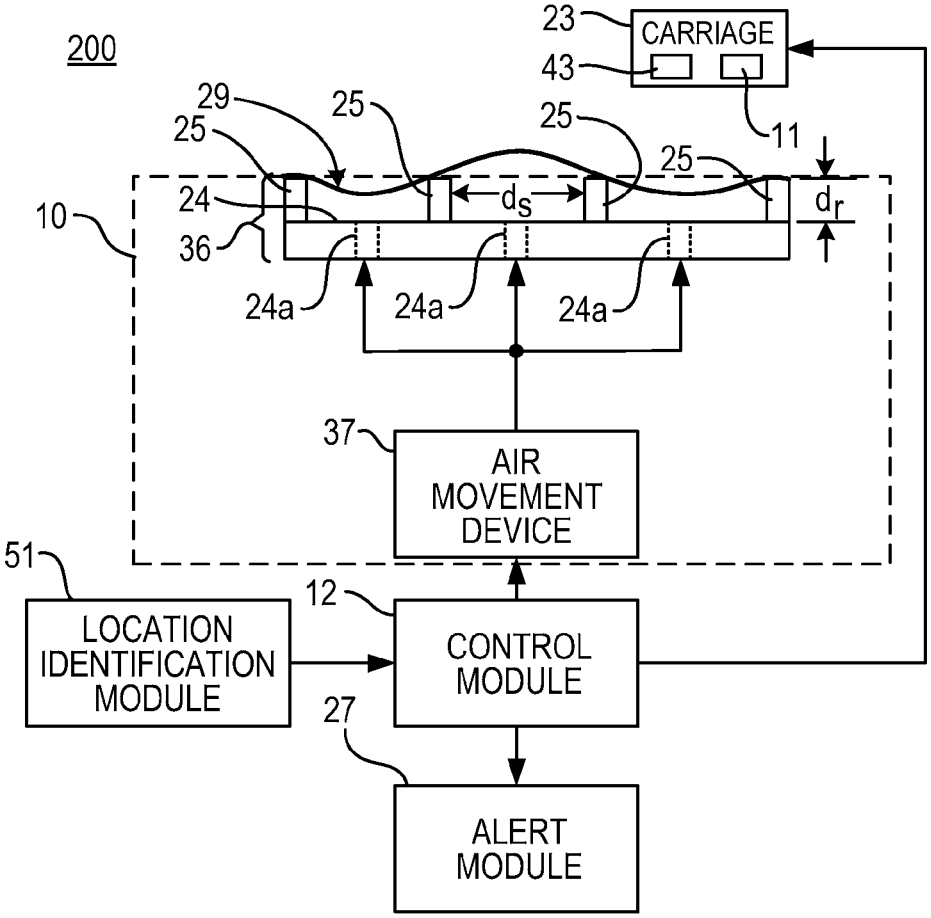

FIGS. 5A and 5B are schematic views of the printing apparatus of FIG. 2 according to examples. Referring to FIGS. 5A-5B, in some examples, the printing apparatus 200 may also include a location identification module 51 and an alert module 27. The location identification module 51 may identify locations along the platen 36 corresponding to portions of the media portion 29 disposed along the platen 36 at a respective time. For example, the location identification module 51 may include a digital signal processor to analyze a respective media shape signal 69*a* (FIGS. 6A and 6B) corresponding to the shape of the respective media portion 29. The alert module 27, for example, may include an audio unit and/or a visual unit. In some examples, the control module 12 may alert a user of the media malfunction event and/or stop a current print job. For example, the control module 12 may communicate with an alert module 27 to provide an audio and/or video alert to a user.

Referring to FIGS. 5A-5B, in some examples, a shape of the media portion 29 may be based on an amount of conformity of the media portion 29 to a portion of the media support assembly 10 such as a platen 36. For example, the shape of the media portion 29 may be based at least on the amount of negative pressure applied to the media portion 29 through the plurality of holes 24*a* by the air movement device 37, respective spacing distances $d_s$ between adjacent ribs 25, and respective distances $d_r$ of the ribs 25 extending outward from the main surface 24. In some examples, the negative pressure may pull the media portion 29 toward the platen 36 to properly position it to receive printing fluid in the print zone as illustrated in FIG. 5A. The negative pressure may also guide it in a media transport direction $d_m$ along a media transport path, and/or reduce media malfunction events. At times, the media portion 29 may not be properly positioned on the platen 36 in the print zone corresponding to a media malfunction event as illustrated in FIG. 5B.

Figure 6A:
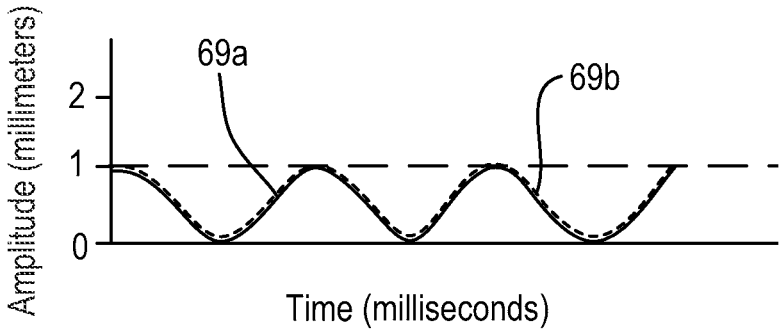
FIGS. 6A and 6B are graphs illustrating a respective media shape signal and a reference signal corresponding to media portions of FIGS. 5A and 5B, respectively.
Figure 6B:
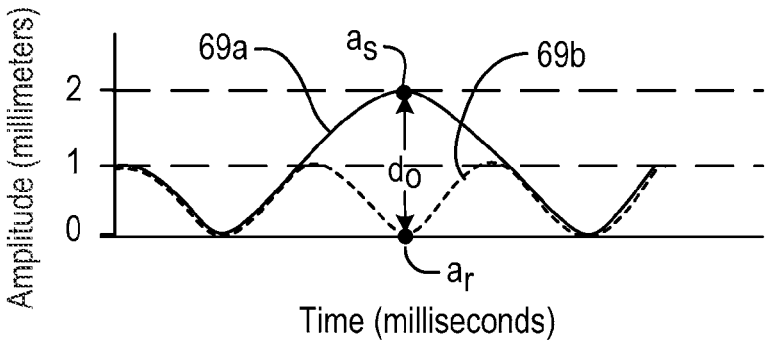

FIGS. 6A and 6B are graphs illustrating a respective media shape signal and a reference signal corresponding to media portions of FIGS. 5A and 53, respectively. Referring to FIGS. 5A-6B, in some examples, a reference signal 69*b* may include a predetermined reference signal such as a sinusoidal signal corresponding to the shape of the media portion 29 when properly positioned on the media support assembly 10 in the print zone. In some examples, the media support assembly 10 may include a platen 36 having a main surface 24 and equally-spaced ribs 25 arranged thereon as illustrated in FIGS. 5A and 53. In FIG. 6A, a media shape signal 69*a* may be generated by the scanning module 11 corresponding to the shape of the media portion 29 properly positioned on the platen 36 in the print zone (FIG. 5A). Thus, the reference signal 69*b* and the media shape signal 69*a* may correspond with each other as illustrated in FIG. 6A. In FIG. 6A, the horizontal axis (x-axis) may correspond to time in milliseconds and the vertical axis (y-axis) may correspond to amplitude in millimeters.

In FIG. 6B, a media shape signal 69*a* may be generated by the scanning module 11 corresponding to the shape of the media portion 29 not properly positioned on the platen 36 in the print zone indicative of a media malfunction event (FIG. 53). In FIG. 63, the horizontal axis (x-axis) may correspond to time in milliseconds and the vertical axis (y-axis) may correspond to amplitude in millimeters. In FIG, 6B, a respective portion of the media shape signal 69*a* includes a respective media shape amplitude a, that exceeds a respective reference amplitude $a_r$ of a corresponding portion of the reference signal 69*b* by an offset amount $d_o$, for example, that is outside an acceptable range. In some examples, an acceptable range, for example, may be an offset amount in a range of 0% to 25% of a respective reference amplitude.

Referring to FIGS. 5A-6B, in some examples, the control module 12 may determine that a media malfunction event occurs in response to a determination that the offset amount $d_o$ is outside the acceptable range. In some examples, the control module 12 may control the air movement device 37 to change an amount of negative pressure applied to the media portion 29 based on a determination of the media malfunction event. For example, the control module 12 may control the air movement device 37 to change the amount of negative pressure applied to a respective portion of the media portion 29 identified by the location identification module 51 based on the determination of the media malfunction event.

In some examples, a control module 12, a location identification module 51, and/or a scanning module 11 may be implemented in hardware, software including firmware, or combinations thereof. The firmware, for example, may be stored in memory and executed by a suitable instruction-execution system. If implemented in hardware, as in an alternative example, the control module 12, the location identification module 51, and/or the scanning module 11 may be implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In other examples, the control module 12, the location identification module 51, and/or the scanning module 11 may be implemented in a combination of software and data executed and stored under the control of a computing device.

Figure 7:
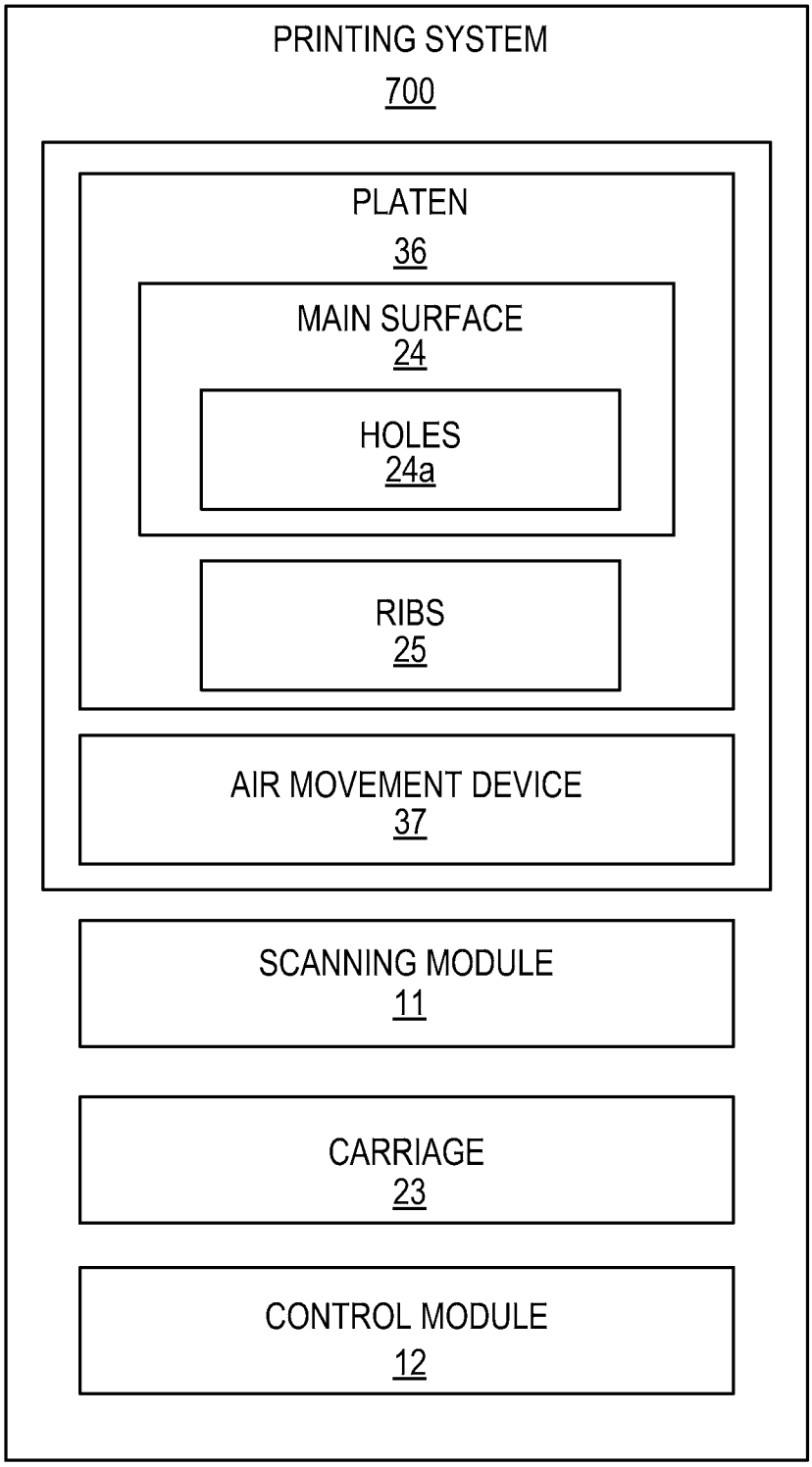
FIG. 7 is a block diagram illustrating a printing system according to an example.

FIG. 7 is a block diagram illustrating a printing system according to an example. Referring to FIG. 7, in some examples, a printing system 700 includes a media support assembly 10, a scanning module 11, a carriage 23, and a control module 12. The media support assembly 10 may position a respective media portion in a print zone to receive a printing fluid thereon. The media support assembly 10 may include a platen 36 and an air movement device 37. The platen 36 may include a main surface 24 and a plurality of ribs 25. The main surface 24 may include a plurality of holes 24*a*. The ribs 25 may extend outward from the main surface 24. The air movement device 37 may be in fluid communication with the plurality of holes 24*a*. The air movement device 37 may move air to create an amount of negative pressure through the plurality of holes 24*a*.

Referring to FIG. 7, in some examples, the scanning module 11 may scan the media portion in the print zone and generate a media shape signal corresponding to a shape of the media portion. The carriage 23 may be coupled to the scanning module 11 and a printhead. The carriage 23 may move the scanning module 11 across the print zone to scan the media portion. The carriage 23 may move the printhead across the print zone to apply printing fluid to the media portion. The control module 12 may compare the media shape signal to a reference signal to form a resultant comparison. The control module 12 may determine a media malfunction event based on the resultant comparison.

Figure 8:
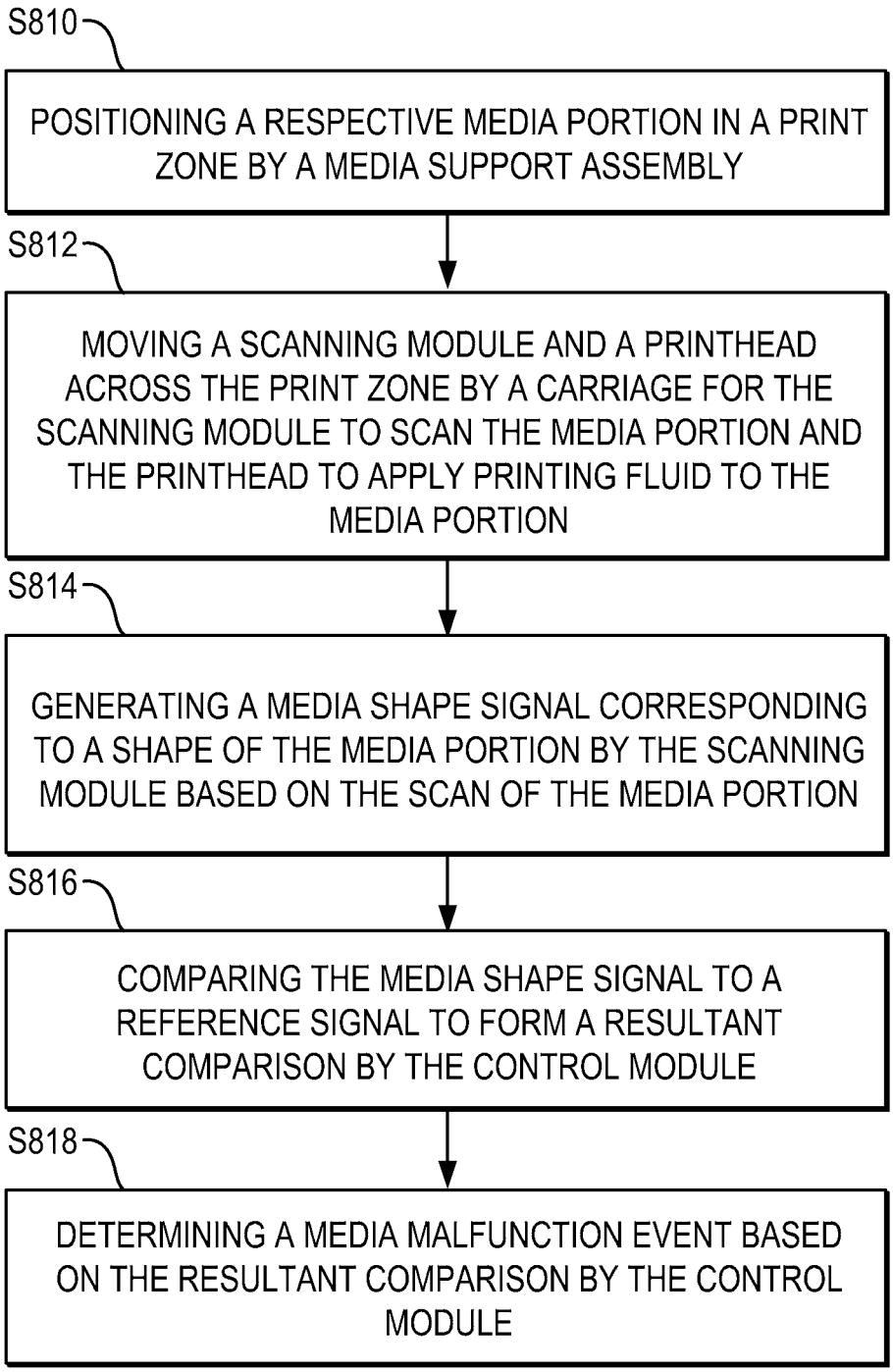
FIG. 8 is a flowchart illustrating a method of determining a media malfunction event of a printing apparatus according to an example.

FIG. 8 is a flowchart illustrating a method of determining a media malfunction event of a printing apparatus according to an example. In block S810, a respective media portion is positioned in a print zone by a media support assembly. For example, the media portion may be positioned on a platen including a main surface having a plurality of holes and a plurality of ribs extending outward from the main surface. Additionally, air may be moved to create an amount of negative pressure through the plurality of holes to pull the media portion toward the platen by an air movement device. In block S812, a scanning module and a printhead are moved across the print zone by a carriage for the scanning module to scan the media portion and the printhead to apply printing fluid to the media portion. In some examples, a scanning module and a printhead may be moved across the print zone by a carriage for the scanning module to scan the media portion and the printhead to apply printing fluid to the media portion in a form of respective swaths to form an image on the media portion.

In block S814, a media shape signal is generated corresponding to a shape of the media portion by the scanning module based on the scan of the media portion. In some examples, the shape of the media portion may correspond to a two-dimensional side view of an image receiving surface of the media portion in the print zone over a respective time period and/or distance. In block S816, the media shape signal is compared to a reference signal to form a resultant comparison by the control module. For example, the respective signals may be subjected to digital signal processing to determine respective differences thereof, and the like. The respective difference may include an offset distance between corresponding portions of the media shape signal and reference signal at a respective time.

In block S818, a media malfunction event is determined based on the resultant comparison by the control module. For example, the media malfunction event may be determined by the control module based on the resultant comparison corresponding to differences between the media shape signal and reference signal outside of a predetermined acceptance range. In some examples, the media malfunction event may be determined by the control module based on the resultant comparison corresponding to differences between the media shape signal and a reference signal outside of a predetermined acceptance range after applying a respective swath by the printhead. Accordingly, whether a media malfunction event has occurred may be determined on a swath by swath basis. In some examples, the method may also include at least one of alerting a user of the media malfunction event and stopping a current print job.

It is to be understood that the flowchart of FIG. 8 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 8 illustrates a specific order of execution, the order of execution may differ from that which is depicted. For example, the order of execution of two or more blocks may be rearranged relative to the order illustrated. Also, two or more blocks illustrated in succession in FIG. 8 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A printing apparatus, comprising:

a media support assembly to position a respective media portion in a print zone to receive a printing fluid thereon;

a scanning module to scan the media portion in the print zone, and to generate a media shape signal corresponding to at least a two-dimensional side view shape of the media portion; and a control module to compare the media shape signal to a reference signal to form a resultant comparison, and to determine a media malfunction event based on the resultant comparison.

2. The printing apparatus of claim 1, wherein the media support assembly comprises:

a platen including a main surface having a plurality of holes, and a plurality of ribs extending outward from the main surface; and an air movement device in fluid communication with the plurality of holes, the air movement device to move air to create an amount of negative pressure through the plurality of holes.

3. The printing apparatus of claim 2, wherein the shape of the media portion is based on at least the amount of negative pressure applied to the media portion through the plurality of holes by the air movement device, respective spacing distances between adjacent ribs, and respective distances of the ribs extending outward from the main surface.

4. The printing apparatus of claim 2, wherein the control module is configured to control the air movement device to change an amount of negative pressure applied to the media portion based on a determination of the media malfunction event.

5. The printing apparatus of claim 4, further comprising:

a location identification module to identify locations of the platen and portions of the media portion corresponding thereto; and the control module is configured to control the air movement device to change the amount of negative pressure applied to a respective portion of the media portion identified by the location identification module based on the determination of the media malfunction event.

6. The printing apparatus of claim 1, further comprising:

a carriage coupled to the scanning module to move the scanning module across the print zone to scan the media portion.

7. The printing apparatus of claim 6, wherein the carriage is coupled to a printhead to move the printhead across the print zone, the printhead to apply printing fluid to the media portion disposed in the print zone; and wherein the scanning module is a line scanner.

8. The printing apparatus of claim 1, wherein the control module is configured to at least one of alert a user of the media malfunction event and stop a current print job.

9. The printing apparatus of claim 1, wherein the control module is configured to determine the media malfunction event based on the resultant comparison corresponding to differences between the media shape signal and a reference signal outside of a predetermined acceptance range.

10. The printing apparatus of claim 1, wherein the reference signal comprises a sinusoidal signal corresponding to the shape of the media portion when properly positioned on the media support assembly in the print zone.

11. The printing apparatus of claim 1, wherein the scanning module is to generate a media shape signal corresponding to at least a two-dimensional side view shape of the media portion over a time period.

12. The printing apparatus of claim 1, wherein the scanning module is to generate a media shape signal corresponding to at least a two-dimensional side view shape of the media portion over a distance.

13. The printing apparatus of claim 1, wherein the scanning module is to generate a media shape signal corresponding to at least a two-dimensional side view shape of the media portion in which two of the dimensions are perpendicular to a feed axis of the printer media.

14. A printing system, comprising:

a media support assembly to position a respective media portion in a print zone to receive a printing fluid thereon, the media support assembly including a platen and an air movement device;

the platen including a main surface having a plurality of holes, and a plurality of ribs extending outward from the main surface; and the air movement device in fluid communication with the plurality of holes, the air movement device to move air to create an amount of negative pressure through the plurality of holes;

a scanning module to scan the media portion in the print zone, and to generate a media shape signal corresponding to at least a two-dimensional side view shape of the media portion;

a carriage coupled to the scanning module and a printhead;

the carriage to move the scanning module across the print zone to scan the media portion; and the carriage to move the printhead across the print zone to apply printing fluid to the media portion; and a control module to compare the media shape signal to a reference signal to form a resultant comparison, and to determine a media malfunction event based on the resultant comparison.

15. A method of determining a media malfunction event of a printing apparatus, the method comprising:

positioning a respective media portion in a print zone by a media support assembly;

moving a scanning module and a printhead across the print zone by a carriage for the scanning module to scan the media portion and the printhead to apply printing fluid to the media portion;

generating a media shape signal corresponding to at least a two-dimensional side view shape of the media portion by the scanning module based on the scan of the media portion;

comparing the media shape signal to a reference signal to form a resultant comparison by the control module; and determining a media malfunction event based on the resultant comparison by the control module.

16. The method of claim 15, wherein the determining a media malfunction event based on the resultant comparison by the control module further comprises:

determining the media malfunction event by the control module based on the resultant comparison corresponding to differences between the media shape signal and the reference signal outside of a predetermined acceptance range.

17. The method of claim 15, wherein the positioning a respective media portion in a print zone by a media support assembly further comprises:

positioning the media portion on a platen including a main surface having a plurality of holes and a plurality of ribs extending outward from the main surface; and moving air to create an amount of negative pressure through the plurality of holes to pull the media portion toward the platen by an air movement device.

18. The method of claim 15, further comprising:

at least one of alerting a user of the media malfunction event and stopping a current print job.

* * * * *